United States Patent [19]

Junkers

[11] Patent Number: 5,005,447

[45] Date of Patent: Apr. 9, 1991

[54] TORQUE WRENCH

[76] Inventor: John K. Junkers, 7 Arrowhead La., Saddle River, N.J. 07458

[21] Appl. No.: 505,976

[22] Filed: Apr. 6, 1990

Related U.S. Application Data

[63] Continuation-in-part of Ser. No. 417,257, Oct. 5, 1989, abandoned, which is a continuation-in-part of Ser. No. 179,387, Apr. 8, 1988, abandoned.

[51] Int. Cl.[5] ..... B25B 13/46

[52] U.S. Cl. ..... 81/57.39

[58] Field of Search ..... 81/57.39, 57.44

[56] References Cited

U.S. PATENT DOCUMENTS 4,524,651 6/1988 Dubiel et al. ..... 81/57.39

*Primary Examiner*—James G. Smith

*Attorney, Agent, or Firm*—Michael J. Striker

[57] ABSTRACT

A torque wrench for tightening or loosening of threaded connectors comprises a turnable engaging unit arranged to be turned and to engage threaded connector so as to tighten or loosen the latter in response to turning of the engaging unit, and a power drive unit for turning the engaging unit, the power drive unit including fluid-operated cylinder piston unit provided with a cylinder and two pistons, the pistons being movable independently of one another, so that when one piston with its smaller piston area is moved it applies a smaller pressure to the engaging unit to provide a smaller torque, while when both the pistons with a greater combined piston area are moved together they apply a greater pressure to the engaging unit to provide a greater torque.

10 Claims, 3 Drawing Sheets

TORQUE WRENCH

CROSS-REFERENCE TO RELATED APPLICATION

This application is a continuation-in-part of patent application Ser. No. 417,257, filed on Oct. 5, 1989, which in turn is a continuation-in-part of application Ser. No. 179,387, filed Apr. 8, 1988 both now abandoned.

BACKGROUND OF THE INVENTION

The present invention relates to torque wrenches. More particularly, it relates to such torque wrenches which has an engaging unit which engages a threaded connector and is turned so as to turn the threaded connector for tightening or loosening, and a fluid-operated drive unit including a cylinder and a piston movable in the cylinder and acting upon the engaging unit to turn the latter.

Torque wrenches of the above mentioned general type are widely known in the art.

The torque output of fluid-operated torque wrenches is based on the torque capacity of the engaging unit which can include for example a square drive, or in other words a square projection to which standard impact sockets can be attached. For example, a 1 inch square drive cannot take more than 3,100 ft./lbs since a torque higher than this would break off the square drive. A 1.5 inch square drive cannot take more than 12,000 ft./lbs. Therefore the tools are designed so that the maximum torque output at maximum pressure does not exceed the maximum torque capacity of a square drive. It is therefore desirable to provide such a torque wrench in which the maximum torque output can be adjusted to the maximum torque capacity of a respective square drive, in a simple, convenient and fool-proof manner, since an error in selecting the maximum torque output can lead to destruction of the square drive.

SUMMARY OF THE INVENTION

Accordingly, it is an object of the present invention to provide a torque wrench of the above mentioned general type, which avoids the disadvantages of the prior art.

More particularly, it is an object of the present invention to provide a torque wrench in which the maximum torque output can be adjusted to the maximum torque capacity of a square drive simply, reliably and in a fool-proof manner.

In keeping with these objects and with others which will become apparent hereinafter, one feature of the present invention resides, briefly stated, in a torque wrench comprising turnable engaging means arranged to be turned and to engage threaded connector so as to tighten or loosen the latter in response to turning of the engaging means, and power drive means for turning the engaging means, the power drive means including fluid-operated cylinder piston means provided with a cylinder and two pistons, the pistons being movable independently of one another, so that when one piston with its smaller piston area is moved it applies a smaller pressure to the engaging means to provide a smaller torque, while when both pistons with a greater combined piston area are moved together they apply a greater pressure to the engaging means to provide a greater torque.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figures 1, 1A:
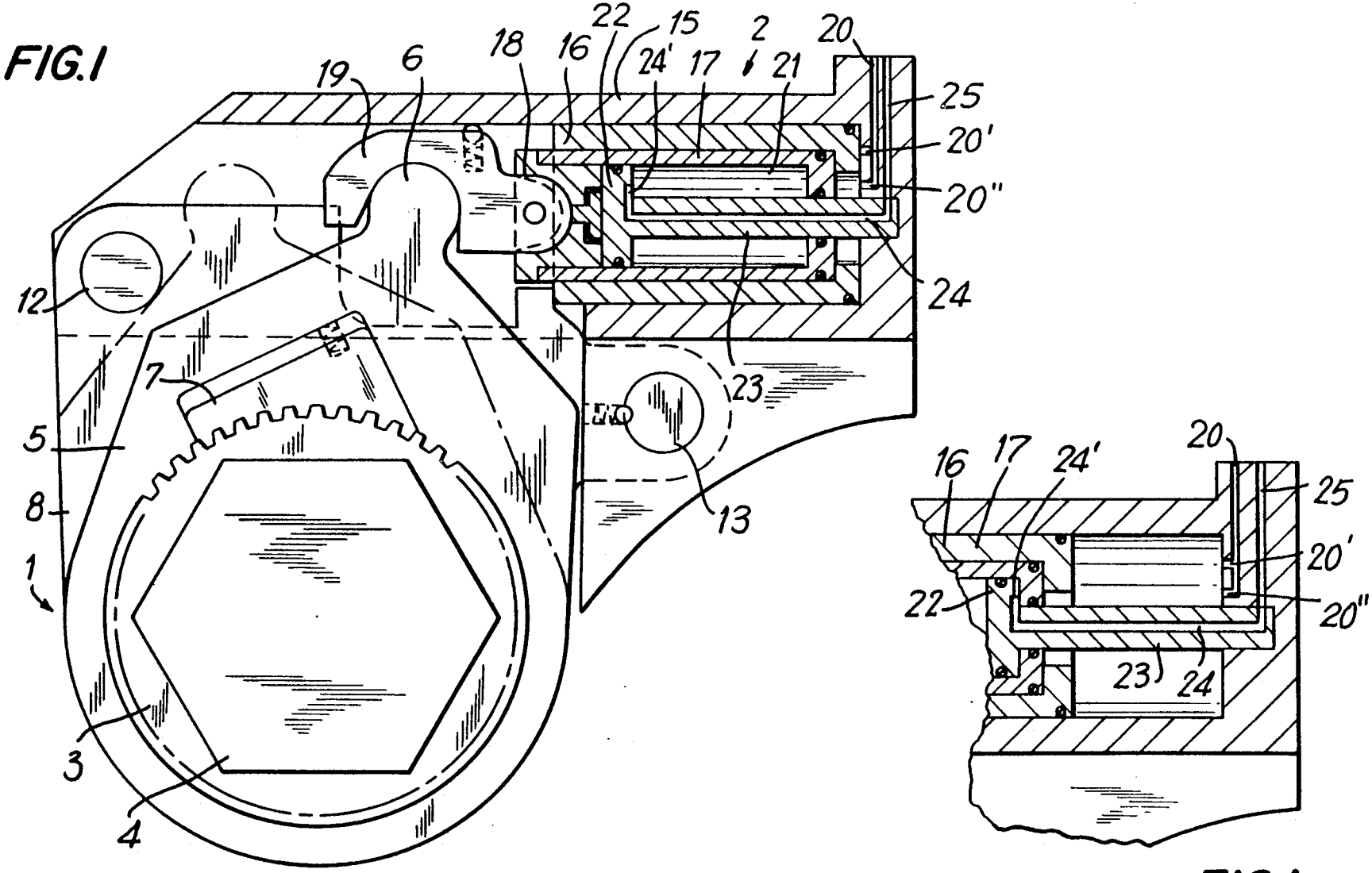
FIG. 1 is a side view of a torque wrench in accordance with the present invention.
FIG. 1*a* is a side view corresponding to the view of FIG. 1, but showing the inventive torque wrench in a different position.

A torque wrench for tightening or loosening threaded connectors in accordance with the present invention is shown in FIG. 1. The torque wrench includes an engaging unit which is turnable and is formed to engage a threaded connector so that when the engaging unit 1 engages a threaded connector and is turned, it turns the threaded connector for tightening or loosening the same. The torque wrench includes further a fluid-operated power drive 2 which acts upon and turns the engaging unit 1 for tightening or loosening a threaded connector.

Figure 2:
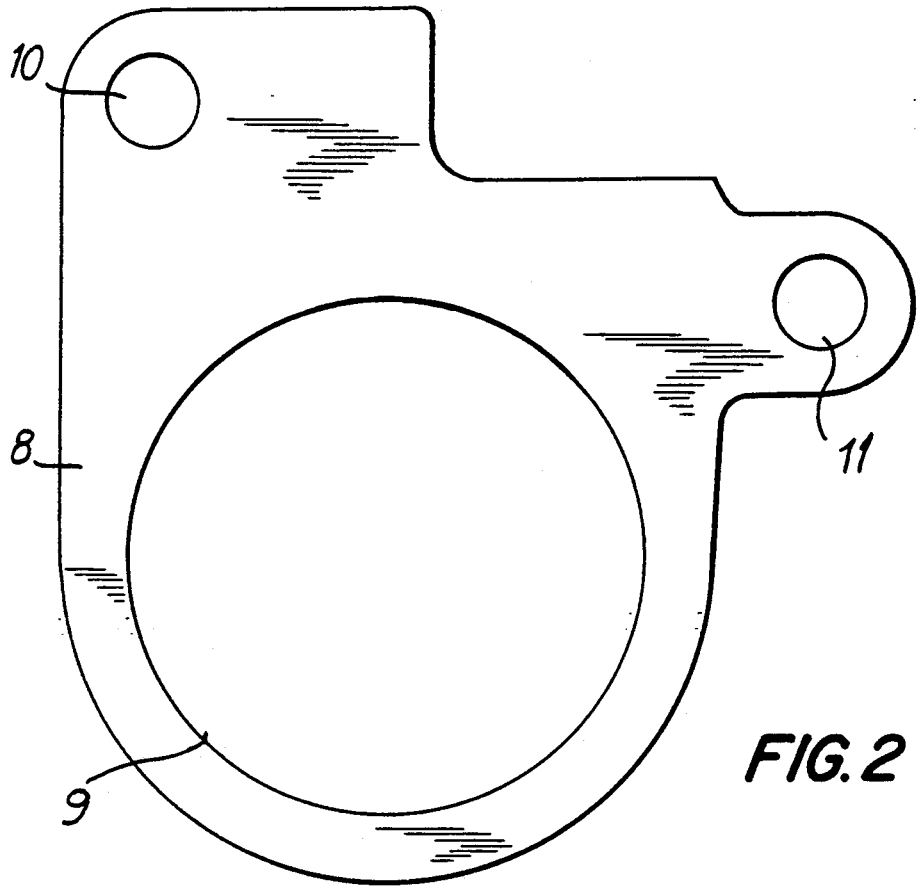
FIGS. 2 and 3 are views showing a link of the inventive torque in accordance with two different modifications.
Figure 3:
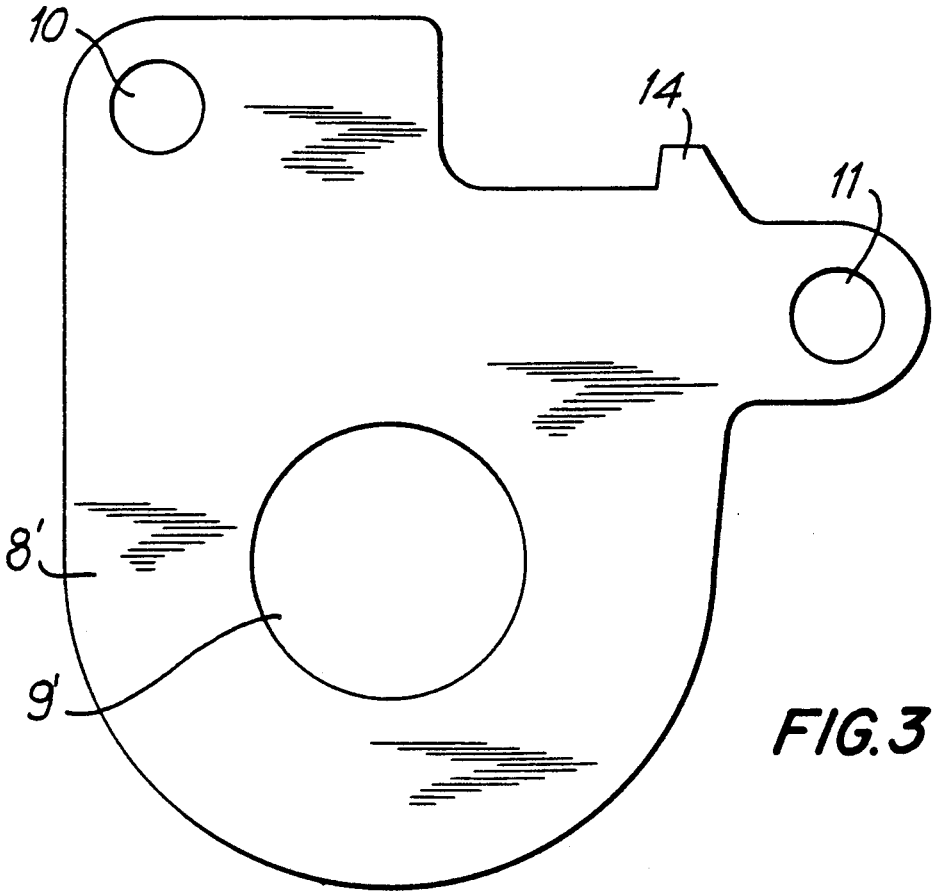

The engaging unit 1 includes a ratchet wheel 3 which has a plurality of outer teeth and is provided with an engaging formation which is formed for example as a hexagonal projection 4 for attaching respective sockets to the projection. The sockets can be fitted on the threaded connectors, such as for example, nuts, bolt heads, etc. It is to be understood that the engaging formation 4 can also be formed as a hexagonal opening which is directly fittable on the above mentioned threaded connectors. The engaging unit 1 further has a drive lever 5 which in its lower end is provided with a circular opening for rotatably receiving the ratchet wheel 3, and on its upper end is provided with a substantially circular head 6. Finally, a pawl 7 is displaceable in a recess of the lever 5 and provided with a plurality of teeth which engage with the teeth of the ratchet wheel 3. The pawl 7 is for example spring biased toward the ratchet 3. Two links or auxiliary elements 8 surround the lever 5 and are provided with a central opening 9 which also rotatably receives the ratchet 3. The links 8 have mounting openings 10 and 11 through which pins 12 and 13 extend for removably mounting the links 8 to a housing of the torque wrench. FIG. 2 shows one of the links 8 or auxiliary elements which is designed for the ratchet 3 suitable for a greater torque capacity, while one of the links or auxiliary elements 8' shown in FIG. 3 is designed for a ratchet having a lower torque capacity, as will be explained in detail hereinbelow. The difference between the links 8' of FIG. 3 and the links 8 of FIG. 2 is that the links 8' are provided with a projection 14.

The fluid-operated power drive unit 2 includes a cylinder 15 which can be formed as a part of the housing of the torque wrench, and two pistons 16 and 17. As can be seen from the drawings, the pistons 16 and 17 are cup-shaped, and the inner piston 17 is arranged in the interior of the outer piston 16. The inner piston 17 is connected with an intermediate piece 18 which in turn is pivotably connected with a bracket 19. The bracket 19 has a recess in which the head 6 of the lever 5 is received in a slidable and turnable manner. The bracket 19 can be spring biased toward the lever 5. A supply opening 20 is provided for supplying a working fluid into the cylinder 15 to the pistons 16 and 17 from a not shown source. The supply line 20 has an outlet 20' which opens behind the right end face of the piston 16 and an outlet 20'' which opens behind the right end of the piston 17.

Additional piston means is further provided in an inner chamber 21 of the inner piston 17. The additional piston means is immovable relative to the cylinder 15 and includes an additional piston 22 provided with a piston rod 23. A throughgoing opening 24 extends through the piston rod 23 and has one end which opens through a passage 24' into the inner chamber 21 and the other end which is connected with a supply line 25 extending from a not shown source of a working fluid.

The torque wrench in accordance with the present invention operates in the following manner. When the links 8 are mounted in the torque wrench and a working fluid is supplied through the line 20 and outlet 20', 20'' into the cylinder 15, it applies pressure to both pistons 16 and 17 which have a relatively great combined piston area. Both pistons 16 and 17 are displaced to the left as shown in FIG. 1*a*, since the links 8 do not have a limiting projection, and in turn displace the intermediate piece 18 and the bracket 19 to the left so as to turn the lever 5 in a counterclockwise direction. The pawl 7 connected with the lever 5 turns the ratchet wheel 3 in the counterclockwise direction so as to tighten or loosen a threaded connector engaged by the engaging formation 4. The position of the lever 5 after turning is shown in a broken line. Then the supply of fluid through the line 20 is interrupted, and the working fluid is supplied through the line 25. The working fluid through the throughgoing opening 24 and passage 24' enters the inner chamber 21 and displaces the pistons 17 and 16 to the right, back to their initial position shown in FIG. 1. The bracket 19 is also moved to the right and turns the lever 5 in an opposite clockwise direction. During this turning of the lever 5 in the opposite direction, the teeth of the pawl 7 just slip over the teeth of the ratchet wheel 3 without turning the latter.

When however it is necessary to use the engaging unit for tightening or loosening smaller threaded connectors which engaging unit therefore must have a lower maximum torque capacity, the links 8 are removed and the links 8' are mounted in the torque wrench. Since the links 8' are provided with the projections 14 which extend in the path of movement of the outer piston 16, the outer piston 16 cannot move to the left during the supply of the working fluid through the supply line 20 into the cylinder 15. In this situation only the inner piston 17 which has a smaller piston area than the combined area of both pistons, is moved to the left under the action of the working fluid and therefore provides for a lower torque output of the lever 5 which corresponds to the lower maximum torque capacity of this engaging unit.

Figure 4:
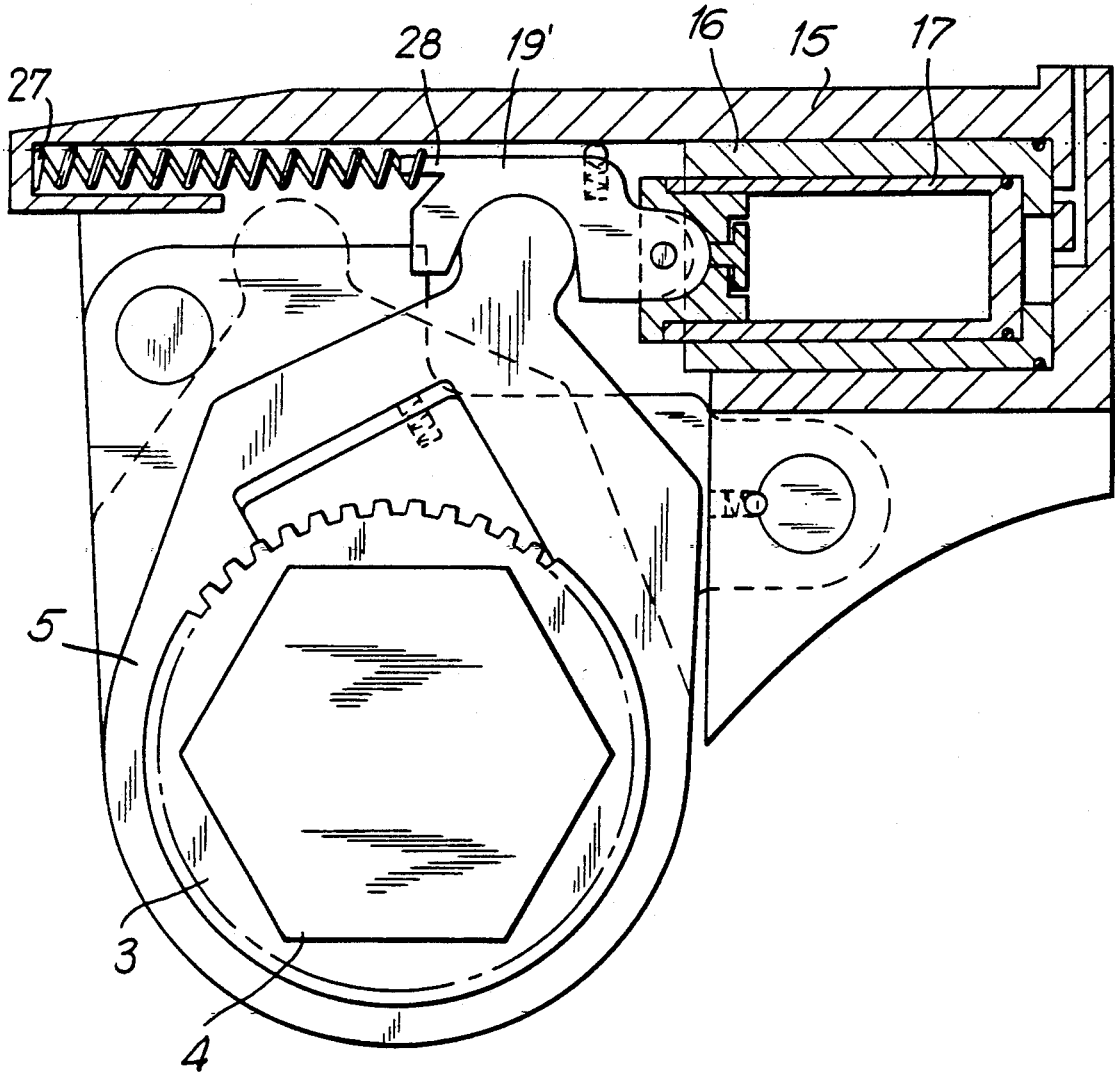
FIG. 4 is a view showing the inventive torque wrench in accordance with a further embodiment.

FIG. 4 shows another embodiment of the torque wrench of the present invention. Here, the return means for returning the pistons to their initial position does not have additional piston means 22, 23, 24 as in the embodiment of FIG. 1. Instead, the return means includes a spring drive 27 which cooperates with a projection 28 of a bracket 19'. During the displacement of the piston or pistons to the left for turning the lever 5 in the counterclockwise direction, the spring 27 is compressed. When afterwards the working fluid is discharged from the cylinder 15 back to its source, the spring 27 applies a return pressure against the projection 28 of the bracket 19', displaces the bracket 19' to the right, and turns the lever 5 in the clockwise direction.

It will be understood that each of the elements described above, or two or more together, may also find a useful application in other types of constructions differing from the types described above.

While the invention has been illustrated and described as embodied in a torque wrench for tightening or loosening a threaded connector, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A torque wrench for tightening or loosening of threaded connectors, comprising turnable engaging means arranged to be turned and to engage threaded connector so as to tighten or loosen the latter in response to turning of said engaging means; power drive means for turning said engaging means to perform a power stroke; and means for connecting said power drive means with said engaging means, said power drive means including fluid-operated cylinder-piston means provided with a cylinder and two pistons, said pistons being movable so that during said power stroke when one piston with a smaller piston area is moved it applies a smaller pressure to said engaging means to provide a smaller torque, while when both said pistons with a greater combined piston area are moved together they apply a greater pressure to said engaging means to provide a greater torque.

2. A torque wrench as defined in claim 1, wherein at least one of said pistons of said fluid-operated drive means is hollow and has an inner space, the other of said pistons of said fluid-operated drive means being arranged in said inner space of said one piston.

3. A torque wrench as defined in claim 1, wherein one of said pistons is connected with said engaging means; and further comprising connecting means for connecting said one piston with said engaging means.

4. A torque wrench as defined in claim 1, wherein said power drive means is arranged to turn said engaging means in a first direction; and further comprising return means arranged to turn said engaging means in an opposite direction.

5. A torque wrench as defined in claim 4, wherein said return means for turning said engaging means in an opposite direction includes spring means acting on said engaging means.

6. A torque wrench as defined in claim 4, wherein one of said pistons has an inner chamber, said return means including piston means movable in said inner chamber and having a throughgoing opening which opens into said inner chamber so that when a working medium is supplied through said opening into said inner chamber, said pistons are moved to move said engaging means in an opposite direction.

7. A torque wrench as defined in claim 6, wherein said piston means of said return means includes an additional piston arranged to abut against said one piston, and a piston rod connected with said additional piston, said throughgoing opening being provided in said piston rod of said piston means.

8. A torque wrench as defined in claim 1; and further comprising an auxiliary element which is releasably connectable with said power drive means and formed so that it blocks movement of the other of said pistons of said fluid-operated drive means, so as to allow the movement of only said one piston.

9. A torque wrench as defined in claim 8, wherein said auxiliary element is a projection which extends toward said other piston of said fluid-operated drive means and prevents the movement of said other piston.

10. A torque wrench as defined in claim 1; and further comprising another auxiliary element which is releasably connectable with said power drive means and formed so as to allow the movement of both said pistons of said fluid-operated drive means together.

* * * * *